US005898126A

United States Patent [19]

Yoshida

[11] Patent Number: 5,898,126

[45] Date of Patent: Apr. 27, 1999

[54] AIR BAG GAS GENERATING COMPOSITION

[75] Inventor: Tadao Yoshida, Souka, Japan

[73] Assignees: Daicel Chemical Industries, Ltd., Sakai; Otsuka Kagaku Kabushiki Kaisha, Osaka; Nippon Koki Co., Ltd., Tokyo, all of Japan

[21] Appl. No.: 08/977,943

[22] Filed: Nov. 24, 1997

Related U.S. Application Data

[62] Continuation of application No. 08/730,155, Oct. 15, 1996, abandoned, which is a continuation of application No. 08/373,024, Jan. 17, 1995, abandoned, which is a continuation-in-part of application No. 08/185,970, filed as application No. PCT/JP93/00634, May 13, 1993, abandoned.

[30] Foreign Application Priority Data

Jul. 13, 1992 [JP] Japan ..... 4-185251
Jul. 13, 1992 [JP] Japan ..... 4-185253

[51] Int. Cl.[6] ..... C06B 31/28; C06B 29/20

[52] U.S. Cl. ..... 149/46; 149/35; 149/79; 149/83; 102/288

[58] Field of Search ..... 149/48, 35, 79, 149/83; 102/288, 289

[56] References Cited

U.S. PATENT DOCUMENTS

| | | | |
|---|---|---|---|
| 3,214,304 | 10/1965 | Vriesen | 149/19 |
| 3,912,561 | 10/1975 | Dion et al. | 149/35 |
| 4,214,438 | 7/1980 | Hamilton et al. | 60/205 |
| 4,358,327 | 11/1982 | Reed, Jr. et al. | 149/19.4 |
| 4,386,979 | 6/1983 | Jackson, Jr. | 149/21 |
| 5,125,684 | 6/1992 | Cartwright | 280/736 |
| 5,167,736 | 12/1992 | Mei et al. | 149/22 |
| 5,197,758 | 3/1993 | Lund et al. | 280/741 |
| 5,431,103 | 7/1995 | Hock et al. | 102/287 |
| 5,467,715 | 11/1995 | Taylor et al. | 102/289 |
| 5,495,807 | 3/1996 | Klober et al. | 102/289 |
| 5,551,725 | 9/1996 | Ludwig | 280/737 |

FOREIGN PATENT DOCUMENTS

| | | |
|---|---|---|
| 0 482 852 | 4/1992 | European Pat. Off. . |
| 0 607 450 | 7/1994 | European Pat. Off. . |
| 1 063 438 | 5/1954 | France . |
| 2 063 586 | 7/1971 | Germany . |
| 2 351 401 | 5/1974 | Germany . |

*Primary Examiner*—Peter A. Nelson
*Attorney, Agent, or Firm*—Armstrong, Westerman, Hattori, McLeland & Naughton

[57] ABSTRACT

The air bag gas generating composition of this invention comprises a nitrogen-containing organic compound and at least one oxidizing agent selected from the group consisting of oxo halogen acid salts and nitrates. The invention provides an air bag gas generating composition without a high shock sensitivity and with an available burning velocity and gas output characteristics and featuring a comparatively low combustion temperature.

10 Claims, 5 Drawing Sheets

AIR BAG GAS GENERATING COMPOSITION

This application is a continuation of application Ser. No. 08/730,155 filed Oct. 15, 1996, now abandoned, which is a continuation of Ser. No. 08/373,024 filed Jan. 17, 1995, now abandoned, which is a continuation-in-part of Ser. No. 08/185,970, filed Jul. 22, 1994, now abandoned, which is a § 371 national phase of international application PCT/JP93/00634 filed May 13, 1993.

TECHNICAL FIELD

This invention relates to an air bag gas generating composition.

BACKGROUND ART

The so-called air bag system in which a nylon bag stowed in the steering wheel assembly or dashboard of a car is inflated on sensing a car crash occurring at high speed to thereby protect the driver and other passengers against being injured or killed by the impact against the steering wheel or front glass is claiming a phenomenally increasing share of the market reflecting the current rigorous requirements concerning driving safety.

In this air bag system, a gas generating composition is ignited, either electrically or mechanically, in an instant on sensing a car crash to thereby inflate the bag with the gas so generated. The gas generating composition is generally supplied as molded into a pellet or disk form. It is essential that such a gas generating composition insures an appropriate burning velocity. If the burning velocity is too low, the bag cannot be inflated in an instant so that the system fails to achieve its object. The gas generating composition is a powdery composition having the property to get ignited by a shock. Shock ignitability is the sensitivity of a powder to shock ignition and an excessively high shock sensitivity is undesirable from the standpoint of safety because it represents a high risk of explosion in the course of production, e.g. in the mixing stage or in the molding stage. Therefore, shock sensitivity is preferably as low as possible.

It is also necessary that the combustion temperature of the gas generating composition be not too high. This is because, to absorb the shock of a car crash to the driver or passenger and help him to escape, generally the inflated air bag then releases the internal gas to shrink but if the combustion temperature is too high, the released gas is also hot enough to cause the passenger to sustain a burn, perforate the bag to detract from its function, or burn the bag to induce a car fire.

The known air bag gas generating compositions comprise sodium azide as the gas generating base and certain additives such as an oxidizing agent [e.g. metal oxides such as $TiO_2$, $MnO_2$, $Fe_2O_3$, CuO, etc., nitrates such as $NaNO_3$, $KNO_3$, $Cu(NO_3)_2$, etc., perchlorates such as $KClO_4$, $NaClO_4$, etc. and chlorates such as $KClO_3$, $NaClO_3$, etc.], a reducing metal [Zr, Mg, Al, Ti, etc.], a cooling agent [$Na_2CO_3$, $K_2CO_3$, $CaCO_3$, $FeSO_4$, etc.], a pH control agent [iron sulfate etc.], a mechanical performance agent [$MoS_2$, KBr, graphite, etc.] and so on.

Such sodium azide-based gas generating compositions are in common use today partly because the generated gas is nitrogen gas for the most part and partly because they have adequate burning velocities and relatively low combustion temperatures. However, sodium azide has the following disadvantages.

(1) It has a risk for causing a fire on decomposition or combustion. Thus, since a fire may be induced in the course of production (on mixing with the oxidizing agent, in the final granulation stage, etc.), it requires a rigorous safety control.

(2) It produces Na on decomposition. Since Na reacts with water to generate hydrogen and become ignited to produce a toxic fume, there is considerable difficulty in treatment.

(3) It reacts with the oxidizing agent to liberate toxic substances such as $Na_2O$ and its derivatives (such as NaOH), thus calling for careful handling in the course of production.

(4) It is acknowledged that the gas generated on combustion or decomposition of sodium azide is rich in nitrogen and very lean in toxic substances so that there is practically no problem. However, for added safety, a further reduction in the level of toxic substances is desirable.

(5) Sodium azide in gas generating compositions is hygroscopic and since the absorption of moisture leads to a decrease in combustibility, there must be an effective provision for the prevention of moisture absorption.

(6) Since it is a toxic and hazardous substance, an additional capital investment is needed for securing safety.

In view of the above disadvantages of sodium azide, the advent has been awaited of an air bag gas generating composition which, compared with the sodium azide-based gas generating composition mentioned above, would have an equivalent or lower shock ignitability, equivalent or higher burning velocity and gas output, and relatively low combustion temperature, and which is lower in the risk of fire and intoxication hazards and lower in costs than the sodium azide-based gas generating composition.

Meanwhile, several attempts have been made to use a nitrogen-containing compound as the base of a gas generating composition. For example, it has been proposed to subject a reducing metal, such as Zr or Mg, and an oxidizing compound, such as potassium perchlorate or potassium chlorate, to redox reaction to thereby ignite the gas generating base with the resultant heat of reaction. As the gas generating base, smokeless powder, nitrocellulose, azodicarbonamide, aminoguanidine and thiourea have been mentioned (Japanese Examined Patent Publications No. 9734/74 and No. 21171/74). However, the burning velocity that can be obtained by the above method is insufficient for practical application to the air bag. Moreover, since the mixture of reducing metal and oxidizing compound has a very high shock sensitivity, the risk of handling hazards is high. Furthermore, the combustion temperature is also suspected to be too high.

Japanese Unexamined Patent Publication No. 118979/75 discloses an air bag gas generating composition comprising a nitrogen-containing compound such as azodicarbonamide, trihydrazinotriazine or the like and an oxidizing agent such as potassium permanganate, manganese dioxide, barium dichromate, barium peroxide or the like. However, the use of potassium permanganate as the oxidizing agent involves the problem of low heat stability (i.e., being prone to spontaneous ignition) and the use of manganese dioxide as the oxidizing agent does not insure satisfactory shock sensitivity or burning velocity, while the use of barium dichromate or barium peroxide as the oxidizing agent gives rise to toxic substances in the liberated gas.

It is an object of this invention to provide an air bag gas generating composition having a shock sensitivity either equivalent to or lower than that of the gas generating composition based on sodium azide.

Another object of this invention is to provide an air bag gas generating composition which is either equivalent to or even higher than the sodium azide-based gas generating composition in burning velocity and gas output.

A still further object of this invention is to provide an air bag gas generating composition which is free from the above-mentioned disadvantages (1) through (6) of the azide compound.

It is a further object of this invention to provide an air bag gas generating composition which is low in combustion temperature with a lower risk of fire and intoxication hazards as compared with sodium azide.

DISCLOSURE OF INVENTION

The inventor of this invention made an extensive exploration to accomplish the above objects with his attention focused on nitrogen-containing compounds which by themselves have very low risks of fire or intoxication hazards due to decomposition or combustion and found that by taking advantage of reducing property of nitrogen-containing compounds and causing a nitrogen-containing compound to react directly with a specific oxidizing agent, i.e., at least one member selected from the group consisting of oxo halogen acid salts and nitrates, instead of combusting the nitrogen-containing compound with the heat of a redox reaction, there can be realized not only a shock sensitivity either equivalent to or lower than that of the sodium azide-based gas generating composition but also a burning velocity and a gas output, both of which are either equivalent to or higher than those of said sodium azide-based composition, as well as a practically useful, low combustion temperature.

This invention is, therefore, directed to an air bag gas generating composition comprising a nitrogen-containing organic compound and at least one oxidizing agent selected from the group consisting of oxo halogen acid salts and nitrates.

In accordance with this invention a nitrogen-containing compound is used as the gas generating base. There is no particular limitation on the nitrogen-containing compound only if it is an organic compound containing at least one nitrogen atom within its molecule. Thus, for example, amino group-containing compounds, nitramine group-containing compounds and nitrosamine group-containing compounds can be mentioned. The amino group-containing compounds that can be used are virtually unlimited, thus including azodicarbonamide (ADCA), urea, aminoguanidine bicarbonate, biuret, dicyandiamide, hydrazides (e.g. acetohydrazide, 1,2-diacetylhydrazine, laurohydrazide, salicylohydrazide, oxalodihydrazide, carbohydrazide, adipodihydrazide, sebacodihydrazide, dodecanedihydrazide, isophthalodihydrazide, methyl carbazate, semicarbazide, formhydrazide, 1,2-diformylhydrazine) and so on. The nitramine group-containing compounds that can be used are also virtually unlimited and include aliphatic and alicyclic compounds containing one or more nitramine groups as substituents, such as dinitropentamethylenetetramine, trimethylenetrinitramine (RDX), tetramethylenetetranitramine (HMX) and so on. The nitrosamine group-containing organic compounds that can be used are also virtually unlimited and include aliphatic and alicyclic compounds containing one or more nitrosamine groups as substituents, such as dinitrosopentamethylenetetramine (DPT). Among these nitrogen-containing compounds, azodicarbonamide has been used widely as a resin blowing agent, and being of low fire-causing potential and low toxicity and, hence, least likely to be hazardous, this compound is particularly suitable. These nitrogen-containing compounds can be used either alone or in combination. Moreover, commercially available nitrogen-containing compounds can liberally selected from a broad range. Generally, it can be used as they are. There is no limitation on the form or grain size of the nitrogen-containing compound and a suitable one can be selectively employed.

The oxidizing agent to be used in this invention is at least one member selected from the group consisting of halogen oxo acid salts and nitrates. As the halogen oxo acid salt, any of the known species can be employed. Preferred are halogenates and perhalogenates and particularly preferred are the corresponding alkali metal salts. The alkali metal halogenates include chlorates and bromates such as potassium chlorate, sodium chlorate, potassium bromate and sodium bromate, among others. The alkali metal perhalogenates include perchlorates and perbromates such as potassium perchlorate, sodium perchlorate, potassium perbromate and sodium perbromate, among others. These oxo halogen acid salts may be used alone or in combination.

As the nitrates, any of the known species can be employed. Alkali metal nitrates, alkaline earth metal nitrates and ammonium nitrate are preferred among them. The alkali metal nitrates include potassium nitrate and sodium nitrate. The alkaline earth metal nitrates include calcium nitrate, strontium nitrate, etc. These nitrates can be used singly or at least two of them may be used in combination.

The amount of said at least one oxidizing agent selected from the group consisting of oxo halogen acid salts and nitrates is generally stoichiometric, that is to say the amount necessary for complete oxidation and combustion of the nitrogen-containing compound based on its oxygen content, but since the burning velocity, combustion temperature and combustion product composition can be freely controlled by varying the ratio of the oxidizing agent to nitrogen-containing organic compound, the amount thereof can be liberally selected from a broad range. By way of illustration, when the gas generating composition contains a nitrogen-containing organic compound and an oxo halogen acid salt, about 20–200 parts by weight, preferably 30–200 parts by weight, of the oxo halogen acid salt may be used per 100 parts by weight of the nitrogen-containing organic compound. When the gas generating composition contains a nitrogen-containing organic compound and a nitrate, the nitrate can be used generally in a proportion of about 5–350 parts by weight, preferably about 10–250 parts by weight, in particular about 10–140 parts by weight, more preferably about 40–100 parts by weight, per 100 parts by weight of the nitrogen-containing compound.

There is no particular limitation on the form or grain size of said at least one oxidizing agent selected from the group consisting of oxo halogen acid salts and nitrates, and a suitable one can be selectively employed.

According to one embodiment of the invention, a oxo halogen acid salt and a nitrate are conjointly used as the oxidizing agent, thereby further lowering the CO concentration in the generated gas.

In accordance with this embodiment of the invention, there can be provided an air bag gas generating composition comprising a nitrogen-containing organic compound, an oxo halogen acid salt and a nitrate, the composition containing about 20–200 parts by weight of the oxo halogen acid salt and about 5–350 parts by weight of the nitrate, relative to 100 parts by weight of the nitrogen-containing organic compound.

The preferred amounts of the halogen oxo acid salt and the nitrate to be used in the three-component composition containing the nitrogen-containing organic compound, the oxo halogen acid salt and the nitrate according to the above embodiment are slightly different from those of the oxo halogen acid salt and the nitrate to be used in the above two-component composition containing the nitrogen-containing organic compound and either one of the oxo halogen acid salt and the nitrate. Thus, in said three-component composition, the amount of the oxo halogen acid salt per 100 parts by weight of the nitrogen-containing organic compound is preferably about 30 to 180 parts by weight, more preferably about 40 to 150 parts by weight, and the amount of the nitrate per 100 parts by weight of the nitrogen-containing organic compound is preferably about 30 to 150 parts by weight, more preferably about 40 to 120 parts by weight.

In the three-component composition according to this embodiment, the basic performance characteristics such as the burning performance, shock ignitability, gas output and the like can be freely controlled by suitably selecting the proportions of the components.

In this embodiment (three-component composition), preferred as the nitrogen-containing organic compound are amino group-containing organic compounds, in particular azodicarbonamide. Preferred as the oxo halogen acid salt are alkali metal perhalogenates (e.g. perchlorates), in particular potassium perchlorate and alkali metal halogenate (e.g. chlorates), in particular potassium chlorate. Preferred as the nitrate are alkali metal nitrates, in particular potassium nitrate, as well as alkaline earth metal nitrate, in particular strontium nitrate.

By suitably selecting the combination of these components as well, the basic performance characteristics of the gas generating composition can be freely controlled. Specific examples of the combination include, for example, ADCA-$KClO_4$-$KNO_3$, ADCA-$KClO_4$-$KClO_3KNO_3$, etc.

The composition of this invention may contain, within the range not affecting its performance characteristics, at least one additive selected from the group consisting of burning control catalysts and antidetonation agents in addition to said at least two essential components which are the nitrogen-containing organic compound and at least one oxidizing agent selected from the group consisting of oxo halogen acid salts and nitrates.

The combustion control catalyst is a catalyst for adjusting the burning velocity, which is one of the basic performance parameters, according to conditions of the intended application, with safety parameters such as low shock ignition and non-detonation properties and other basic performance parameters such as the gas output being fully retained. Such combustion control catalyst includes, among others, the oxides, chlorides, carbonates and sulfates of Period 3, Period 4 and Period 6 elements of the periodic table of the elements, cellulosic compounds and organic polymers. The oxides, chlorides, carbonates and sulfates of the Period 3, Period 4 and Period 6 elements include ZnO, $ZnCO_3$, $MnO_2$, $FeCl_3$, CuO, $Pb_3O_4$, $PbO_2$, PbO, $Pb_2O_3$, S, $TiO_2$, $V_2O_5$, $CeO_2$, $Ho_2O_3$, $CaO_2$, $Yb_2O_3$, $Al_2(SO_4)_3$, $ZnSO_4$, $MnSO_4$, $FeSO_4$, $Fe_2O_3$, $Fe_3O_4$, FeO, $Cr_2O_3$, NiO, etc. Among the cellulosic compounds mentioned above may be reckoned carboxymethylcellulose, methylcellulose, hydroxypropylcellulose, hydroxymethylcellulose, ethers of these cellulose derivatives, microcrystalline cellulose powder and so on. The organic polymers mentioned above include, among others, soluble starch, polyvinyl alcohol and its partial saponification product, and so on. These combustion control catalysts can be used alone or in combination. The amount of the combustion control catalyst is not critical and can be liberally selected from a broad range. Generally, however, this catalyst is used in a proportion of about 0.1–100 parts by weight, preferably about 1–50 parts by weight, more preferably about 1–20 parts by weight, based on 100 parts by weight of the total amount of the nitrogen-containing organic compound and oxidizing agent combined, the oxidizing agent being at least one member selected from the group consisting of oxo halogen acid salts and nitrates. The grain size of the combustion control catalyst is not critical and can be appropriately selected.

The antidetonation agent is added for preventing the detonation which may occur when the gas generating composition is involved in a fire in the course of production, handling or transportation or subjected to an extraordinary impact. As the addition of such antidetonation agent eliminates the risk of detonation, the safety of the gas-generating composition in various stages of production, handling and transportation can be further enhanced. As the antidetonation agent, a variety of known substances can be utilized. Thus, for example, oxides such as $SiO_2$, bentonite, alumina, diatomaceous earth, etc. and carbonates and bicarbonates of metals such as Na, K, Ca, Mg, Zn, Cu, Al, etc. can be mentioned. The amount of such antidetonation agent is not critical and can be liberally selected from a broad range. Generally, it can be used in a proportion of about 1 to 100 parts by weight, preferably about 5–30 parts by weight relative to 100 parts by weight of the total amount of the nitrogen-containing organic compound and oxidizing agent combined, the oxidizing agent being at least one member selected from the group consisting of oxo halogen acid salts and nitrates.

The composition of this invention may further contain, within the range not affecting its performance characteristics, a combustion temperature control agent and/or a burning velocity control agent. The combustion temperature control agent includes the carbonates and bicarbonates of metals such as Na, K, Ca, Mg, etc., among others. The burning velocity control agent includes the sulfates of Al, Zn, Mn, Fe, etc., among others. Further, $SiO_2$ is also useful for controlling the combustion temperature or burning velocity. The proportion of at least one member selected from the group consisting of such combustion temperature control agent and burning velocity control agent may generally be about 50 parts by weight or less, preferably about 1 to 20 parts by weight, per 100 parts by weight of the total amount of the nitrogen-containing organic compound and at least one oxidizing agent selected from the group consisting of the oxo halogen acid salt and nitrate combined.

Within the range not interfering with its performance characteristics, the composition of this invention may further contain a variety of additives which are commonly used in the conventional air bag gas generating compositions.

The composition of this invention can be manufactured by blending the above-mentioned components. While the resulting mixture as such can be used as the gas generating composition, it may be provided in the form of molded composition. Such a molded composition can be manufactured by the conventional procedure. For example, the composition of this invention may be mixed with a binder in a suitable ratio and the resulting mixture may be molded or molded and dried. During the mixing, it is particularly preferred to add a solvent such as water to the mixture. The binder may be any binder that is routinely employed. The form of such molded composition is not critical. Thus, it may be a pellet, disk, ball, bar, hollow cylinder, confetti or tetrapod, for instance. It may be solid or porous (e.g. honeycomb-shaped). If desired, the pellet or disk-shaped product may have on one side thereof a suitable number of projections. It is also possible to process each component into a discrete preparation and mix them in use.

The composition of this invention has the following advantages.

(a) The composition of this invention is remarkably low in toxicity and the potential to cause a fire on decomposition or combustion. Therefore, the risk of hazards in handling in the course of production is very low. It can be easily molded, too.

(b) The composition of this invention has a low shock sensitivity which is either equivalent to or lower than that of the sodium azide-based gas generating composition and is, therefore, is very safe.

(c) The composition of this invention is equivalent or superior to the sodium azide-based gas generating composition in burning velocity and gas output.

(d) Like the sodium azide-based gas generating composition, the composition of this invention has a relatively low combustion temperature so that it does not have the risk of causing a burn to the driver, passenger or a perforation or burning of the bag. In addition, the level of toxic substances in the product gas is very low.

(e) Since the base nitrogen-containing compound of the composition of this invention is not hygroscopic, it is not necessary to provide for the prevention of moisture absorption.

(f) The composition of this invention can be produced at remarkably reduced cost.

(g) Compared with the prior art gas generating compositions, the composition of this invention can be easily disposed of.

BEST MODE OF PRACTICING THE INVENTION

The following examples are intended to describe this invention in further detail. The chemical names of the compounds indicated by abbreviations or chemical formulas in the example are as follows.

ADCA: azodicarbonamide
DPT: dinitrosopentamethylenetetramine
RDX: trimethylenetrinitramine
HMX: tetramethylene tetranitramine
NQ: nitroguanidine
$KClO_4$: potassium perchlorate
$KNO_3$: potassium nitrate
CuO: cupric oxide
$CaO_2$: calcium peroxide
$NH_4ClO_4$: ammonium perchlorate
$NH_4NO_3$: ammonium nitrate
ZnO: zinc oxide

EXAMPLE 1

A nitrogen-containing compound and an oxidizing agent selected from oxo halogen acid salts and nitrates, with or without a combustion control catalyst, were blended according to the formula shown below in Table 1 to provide compositions (No. 1–No. 17) of this invention.

TABLE 1

| No. | Gas generating base | Amount (wt %) | Oxidizing agent | Amount | Combustion control catalyst | Amount |
|---|---|---|---|---|---|---|
| 1 | ADCA | 45 | $KClO_4$ | 55 | CuO | 10 |
| 2 | ADCA | 35 | $KClO_4$ | 21 | $CaO_2$ | 44 |
| 3 | Urea | 37 | $KClO_4$ | 63 | CuO | 10 |
| 4 | Urea | 30 | $KClO_4$ | 36 | $CaO_2$ | 34 |
| 5 | Hexamethylenetetramine | 18 | $KClO_4$ | 82 | CuO | 10 |
| 6 | Guanidine bicarbonate | 56 | $KClO_4$ | 44 | CuO | 10 |
| 7 | Biuret | 40 | $KClO_4$ | 60 | CuO | 10 |
| 8 | ADCA | 42 | $KClO_4$ | 50 | $CaO_2$ | 10 |
| 9 | ADCA | 40 | $KClO_4$ | 40 | $CaO_2$ | 20 |
| 10 | ADCA | 37 | $KClO_4$ | 30 | $CaO_2$ | 30 |
| 11 | ADCA | 30 | $KClO_4$ | 10 | $CaO_2$ | 60 |
| 12 | ADCA | 41 | $KNO_3$ | 59 | — | |
| 13 | ADCA (30% ZnO) | 47 | $KNO_3$ | 53 | — | |
| 14 | Cyanoguanidine | 29 | $KClO_4$ | 71 | CuO | 10 |
| 15 | ADCA | 45 | $KClO_4$ | 55 | CuO<br>$CaO_2$ | 10 |
| 16 | Oxalodihydrazide | 40 | $KClO_4$ | 60 | CuO | 10 |
| 17 | Carbohydrazide | 39 | $KClO_4$ | 61 | CuO | 10 |

ADCA (30% ZnO): an ADCA—ZnO mixture containing 30 wt. % of ZnO

Using a hydraulic tablet machine, each of the above compositions Nos. 1–17 of this invention was compressed at 60 kg/cm$^2$ to prepare pellets (5 mm in diameter and 5.0 mm high) and each pellet sample was subjected to the 7.5-liter tank (or bomb) test. The results are shown in Table 2.

[Tank test]

The procedure of the tank test is now described with reference to FIGS. 1–3.

1. Weigh out a predetermined amount of the sample (gas generating composition (9), pellets of compositions Nos. 1–17 of this invention) to place it into a chamber (1). The chamber is provided in two sizes. The larger chamber measures 50 mm in inside diameter and 50 mm high (FIG. 2) and the smaller chamber measures 30 mm in inside diameter and 50 mm high (FIG. 3).
2. Fit up the chamber with a nozzle having a predetermined diameter (10) and an aluminum rupture plate (11) (0.2 mm thick).
3. Set an ignitor (12) in the reaction chamber. The ignitor comprises a Saran® wrap containing 0.3 or 1.0 g of a mixture of boron and $KNO_3$ (2:8) (hereinafter referred to as "B—$KNO_3$") and a Ni—Cr wire coil (13) (0.3 mm dia.×100 mm long) passed through the wrap.
4. Cover the chamber and connect it to a gas trapping tank (2).
5. Connect ignition leads (4) to electrodes (5) on the tank cover.
6. Fix the tank cover (3) on the tank (2).
7. Connect the measuring circuit wiring.
8. After counting down, energize the ignitor and record the chamber and tank time-pressure curves and tank internal temperature.

TABLE 2

| No. | Amount (g) | Igniter (g) | Chamber L/S | Chamber Nozzle diameter | $CP_{max}$ (kgf/cm$^2$) | $W_{1/2}$ (msec) | $BP_{max}$ (kgf/cm$^2$) | $T_{90}$ (msec) | $BT_{max}$ (°C.) |
|---|---|---|---|---|---|---|---|---|---|
| 1 | 5 | 0.3 | S | 6 mm | >140 | — | 7.5 | — | 400 |
| | 5 | 1.0 | L | 4 mm | 140 | 39 | 4.7 | 34 | 150 |
| | 2 | 0.3 | S | 6 mm | 46 | 4.2 | 0.7 | 10 | 72 |
| | 2 | 1.0 | S | 6 mm | 140 | 7.2 | 4.4 | 8 | 280 |
| | 5 | 1.0 | L | 6 mm | 100 | 29 | 4.8 | 28 | 225 |
| | 5 | 1.0 | L | 4 mm | 149 | 27 | 4.6 | 26 | 249 |
| 2 | 5 | 1.0 | L | 4 mm | ca. 134 | — | 3.4 | — | 176 |
| 3 | 5 | 1.0 | L | 4 mm | 65 | 66 | 3.5 | 66 | 176 |
| 5 | 5 | 1.0 | L | 4 mm | 74 | 42 | 4.8 | 84 | 366 |
| 6 | 5 | 1.0 | L | 4 mm | 82 | 56 | 2.4 | 38 | 128 |
| 7 | 5 | 1.0 | L | 4 mm | 54 | 54 | 2.3 | 49 | 147 |
| 8 | 5 | 1.0 | L | 6 mm | 54 | 22 | 4.7 | 51 | 192 |
| 12 | 5 | 1.0 | L | 4 mm | 50 | 15 | 1.4 | 25 | 106 |
| 13 | 5 | 1.0 | L | 4 mm | 65 | 15 | 1.6 | 20 | 76 |
| | 5 | 1.o | S | 6 mm | 79 | 4 | 1.8 | 3 | 106 |
| 14 | 5 | 1.0 | L | 4 mm | 140 | 29 | 5.6 | 18 | 264 |
| 15 | 5 | 1.0 | L | 4 mm | 90 | 57 | 4.2 | 50 | 243 |
| 16 | 5 | 1.0 | L | 8 mm | 120 | 10 | 6.0 | 10 | — |
| 17 | 5 | 1.0 | L | 9 mm | 70 | 12 | 6.0 | 15 | — |

L: Large; S: Small

In Table 2, $CP_{max}$ represents the maximum pressure (kg/cm$^2$) in the combustion chamber, $W_{1/2}$ represents the time (msec) in which the internal pressure of the chamber becomes ½ of the maximum pressure, $BP_{max}$ represents the maximum pressure (kg/cm$^2$) within the tank, $T_{90}$ represents the time (msec) in which the internal pressure of the tank reaches 90% of the maximum pressure, and $BT_{max}$ represents the maximum temperature (°C.) within the tank. Among these parameters, $T_{90}$ is a value simulating the inflation time of the air bag. $CP_{max}$ is an index, the values of which indicate that the compositions of this invention retain a satisfactory performance as gas generating compositions. $W_{1/2}$ is a parameter simulating the burning velocity of the gas generating composition within the chamber. $BP_{max}$ is a parameter indicating the gas generating capacity per unit mass of the gas generating composition. $BT_{max}$ is a parameter simulating the temperature of the gas in the fully inflated air bag.

It should be noted that the experiment conducted in these examples was a simplified experiment by which to estimate the basic performance characteristics, particularly burning velocity and gas generating capacity. Thus, a coolant and a filter were not used. Therefore, the results of the burning temperature (the maximum temperature within the tank) will not be reproduced when the composition of the invention is actually used for inflating the air bag in a actually used system.

EXAMPLE 2

A nitrogen-containing compound and an oxidizing agent selected from oxo halogen acid salts and nitrates, with or without the combustion control catalyst, were blended according to the formulas (wt. %) shown below in Table 3 to provide compositions of this invention.

Each of the compositions of this invention was subjected to the following shock ignitability (sensitivity) test. As controls, the prior art gas generating compositions ($NaN_3$—$KClO_4$—$Fe_3O_4$ and $NaN_3$—CuO) were also subjected to the shock ignitability test.

[Shock ignitability test]

This test is designed to measure the degree of readiness of gas generating compositions to be ignited by a shock (shock ignition sensitivity). The experimental procedure is now described with reference to FIGS. 4–7.

1. [FIG. 4]

Weigh 5 g of the sample powder (16) into a stainless steel test vessel (15). The vessel (15) is a bottomed cylinder made of steel and measuring 31 mm in inner diameter, 36 mm in outer diameter, 2.5 mm thick and 55 mm high.

2. [FIG. 5]

Place polyethylene cards (17) of required thickness on the sample. The sum of the thicknesses of these polyethylene cards (17) is called the gap length.

3. [FIG. 6]

Drill a hole, 6.5 mm in diameter, through two 1 mm-thick polyethylene cards (18), set a detonator (19) in the hole and set the assembly in a steel vessel (15). The detonator used was Nippon Kayaku electric detonator No. 0.

4. [FIG. 7]

For testing any gas generating composition containing a hygroscopic gas generating base (e.g. sodium azide), cover the steel vessel (15) with paraffin paper (20) for preventing the absorption of moisture.

5. Set this steel vessel securely in a vice in an explosion dome and energize to fire the detonator.
6. Observe whether the sample is ignited or not.
7. If no ignition takes place at the gap length of 1 mm, set 20 g of sample powder (16), insert the detonator D (19) into the sample, place a threaded lid on the stainless steel vessel (15), and perform the test. By this procedure, even a material with a very low shock sensitivity can be ignited or exploded.

Table 3 shows the ignition limit gap length (ignited up to that gap length) and the non-ignition limit gap length (not ignited beyond that gap length).

In this test, a greater critical gap length value represents a higher shock ignition sensitivity. In other words, the greater the critical ignition gap length, the higher is the shock ignition sensitivity and, hence, the risk of hazards.

TABLE 3

| No. | Gas generating base | Amount (wt %) | Oxidizing agent | Amount (wt %) | Combustion control catalyst | Amount (wt. %) | Gap length (mm) Ignition | Non-ignition |
|---|---|---|---|---|---|---|---|---|
| 1 | DPT | 29 | $KClO_4$ | 71 | — | — | 3 | 4 |
| 2 | DPT | 29 | $KClO_4$ | 71 | CuO | 10 | 4 | 5 |
| 3 | RDX | 68 | $KClO_4$ | 32 | — | — | 4 | 5 |
| 4 | RDX | 68 | $KClO_4$ | 32 | CuO | 10 | 3 | 4 |
| 5 | HMX | 68 | $KClO_4$ | 32 | — | — | 4 | 5 |
| 6 | HMX | 68 | $KClO_4$ | 32 | CuO | 10 | 5 | 6 |
| 7 | NQ | 60 | $KClO_4$ | 40 | — | — | 4 | 5 |
| 8 | RDX | 61 | $NH_4ClO_4$ | 39 | — | — | 3 | 4 |
| 9 | HMX | 61 | $NH_4ClO_4$ | 39 | — | — | 8 | 10 |
| 10 | RDX | 65 | $KNO_3$ | 35 | — | — | 2 | 3 |
| 11 | HMX | 65 | $KNO_3$ | 35 | — | — | 2 | 3 |
| 12 | RDX | 48 | $NH_4NO_3$ | 52 | — | — | 2 | 3 |
| 13 | HMX | 48 | $NH_4NO_3$ | 52 | — | — | 2 | 3 |
| 14 | ADCA | 42 | $KClO_4$ | 58 | ZnO | 4.7 | 32 | 34 |
| 15 | ADCA | 45 | $KClO_4$ | 55 | ZnO | 5 | 25 | 32 |
| 16 | ADCA | 45 | $KClO_4$ | 55 | — | — | 6 | 8 |
| 17 | ADCA | 45 | $KClO_4$ | 55 | — | — | with lid, insertion | 1 |
| 18 | ADCA | 45 | $KClO_4$ | 55 | CuO | 10 | 1 | 2 |
| 19 | ADCA | 45 | $KClO_4$ | 55 | $Pb_2O_4$ | 10 | 1 | 2 |
| 20 | ADCA | 45 | $KClO_4$ | 55 | CuO | 1 | with lid, insertion | 1 |
| 21 | ADCA | 70 | $KClO_4$ | 30 | CuO | 100 | with lid, insertion | 1 |
| Control A | $NaN_3$ | 60 | $KClO_4$ | 10 | $Fe_3O_4$ | 30 | 36 | 37 |
| Control B | $NaN_3$ | 40 | CuO | 60 | — | — | 4 | 5 |

It is clear from Table 3 that the shock sensitivity of the composition of this invention is equal to or lower than that of the prior art composition, thus being as safe as or safer than the latter.

EXAMPLE 3

Azodicarbonamide (abbreviated as ADCA in the following table) and an oxidizing agent selected from oxo halogen acid salts and nitrates, with or without a combustion control catalyst, were blended according to the formulas (wt. %) shown in Table 4 to provide compositions of this invention.

Using a hydraulic tablet machine, each of these compositions was compressed at 60 kg/cm$^2$ to prepare pellets (7.6 mm in diameter, 3 mm high) and the pellet sample was subjected to the 7.5-liter tank test described hereinbefore. The results are shown in Table 4.

As a control, the prior art gas generating composition ($NaN_3$—CuO) was also subjected to the 7.5-liter tank test. The results are similarly shown in Table 4.

In this 7.5-liter tank test, two 0.1 mm-thick aluminum plates were used as the rupture plate to be attached to the chamber cover.

TABLE 4

| No. | Gas generating base | Amount (wt %) | Halogen oxo acid salt | Amount (wt %) | Combustion control catalyst | Amount (wt %) | Amount (g) | Chamber L/S | Nozzle dia. | $BP_{max}$ (kgf/cm$^2$) | $T_{90}$ (msec) |
|---|---|---|---|---|---|---|---|---|---|---|---|
| 1 | ADCA | 45 | $KClO_3$ | 55 | CuO<br>Soluble starch | 10<br>2.2 | 10 | L | 12 mm | 7.0 | 25 |
| 2 | ADCA | 45 | $KClO_3$ | 55 | CuO<br>Soluble starch | 10<br>1.1 | 10 | L | 8 mm | 7.6 | 29 |
| 3 | ADCA | 45 | $KClO_3$ | 55 | CuO | 1 | 10 | S | 11 mm | 4.2 | 24 |
| 4 | ADCA | 50 | $KClO_3$ | 50 | — | — | 10 | S | 11 mm | 4.1 | 20 |
| 5 | ADCA | 70 | $KClO_3$ | 30 | — | — | 10 | S | 7 mm | 7.2 | 26 |
| Control | $NaN_3$ | 60 | — | — | CuO | 40 | 10 | S | 9 mm | 3.8 | 25 |

L: Large; S: Small

EXAMPLE 4

An air bag inflator reactor was loaded with 20 g of pellets (12.3 mm dia.×3 mm thick) of the composition of this invention comprising 45 parts by weight of azodicarbonamide, 55 parts by weight of sodium chlorate and 2.75 parts by weight of $MnO_2$ and the loaded inflator was connected to a 28.6-liter tank equipped with a pressure sensor. Using 1 g of B-$KNO_3$ the pellets were ignited for combustion. The maximum pressure within the tank was 4.3 kgf/cm$^2$ gauge and the tank internal pressure rise time associated with combustion of this composition was 50 msec.

As a control, 20 g of pellets (12.3 mm dia.×3 mm thick) of the gas generating composition suggested by Japanese Examined Patent Publication No. 21171/74, i.e. a composition comprising 200 parts by weight of azodicarbonamide, 90 parts by weight of sodium chlorate and 10 parts by weight of aluminum, were also subjected to the same tank test. As a result, the rapid combustion of the ignitor alone was observed and the gas generating composition was not as efficiently combusted. Moreover, the maximum ultimate pressure in the tank was as low as 0.3 kgf/cm$^2$ gauge.

EXAMPLES 5 and 6

Two-hundred (200) parts by weight of azodicarbonamide (abbreviated as ADCA in the following table) was blended with 90 parts by weight of sodium chlorate to provide a composition of this invention.

A control gas generating composition was prepared according to the suggestion made in Japanese Examined Patent Publication No. 21171/74. Thus, 200 parts by weight of azodicarbonamide was blended with 90 parts by weight of sodium chlorate and 10 parts by weight of Zr powder to provide a control composition.

Each of the above compositions was molded into pellets (5 mm in diameter×5.0 mm high) in the same manner as Example 1 and the pellet samples were subjected to the following nozzle-pipe combustion test and the shock ignitability test. In the test, the occurrence of flame was also checked. The results are shown in Tables 5 and 6.

[Nozzle-pipe combustion test]

1. Place 5 g of the gas generating composition in a flame-resistant steel vessel (a hollow cylinder measuring 50 mm in inside diameter and 50 mm high), set a Ni—Cr wire and cover the vessel. The cover is formed with an opening 7 mm in diameter.
2. Apply a voltage of 10 V across the Ni—Cr wire through a Slidac to ignite the gas generating composition.
3. Initially a white smoke emerges from the opening and, then, the composition becomes fired. The flame retention time (combustion time) from the ignition to extinguishment of the flame is visually monitored and, at the same time, recorded with a video camera.

TABLE 5

| | Gas generating base | Amount (wt %) | Halogen oxo acid salt | Amount (wt %) | Combustion control catalyst | Amount (wt %) | Gap length (mm) Ignition | Gap length (mm) Non-ignition | Combustion time (sec.) | Occurrence of a fire |
|---|---|---|---|---|---|---|---|---|---|---|
| Example 6 | ADCA | 200 | $NaClO_3$ | 90 | — | — | 6 | 8 | 18 | NO |
| Control | ADCA | 200 | $NaClO_3$ | 90 | Zr | 10 | 12 | 16 | 14 | YES |

TABLE 6

| | Gas generating base | Amount (wt %) | Halogen oxo acid salt | Amount (wt %) | Combustion control catalyst | Amount (wt %) | Combustion time (sec.) | Occurrence of a fire |
|---|---|---|---|---|---|---|---|---|
| Example 7 | ADCA | 200 | $NaClO_3$ | 90 | — | — | 15 | NO |
| Control | ADCA | 200 | $NaClO_3$ | 90 | Zr | 10 | 7 | YES (under certain conditions) |

It is apparent from Table 5 that the addition of a reducing metal such as Zr increases the risk potential of a gas generating composition. While the combustion of the composition of this invention occurs at low temperature without production of a flame, the Zr-containing control composition is combusted with production of a flame so that the temperature of the product of combustion is high. It is, therefore, clear that it is not recommendable to add a reducing metal, such as Zr, Al or Mg, to the composition of this invention.

It is clear from Table 6 that the Zr-containing control composition is combusted with production of a flame so that the temperature of the reaction product is high.

EXAMPLE 7

To investigate its combustibility, the composition of this invention was subjected to the strand burner test (cf. "Combustion characteristics of sodium azide gas generating systems", the Proceedings of the 1992 Annual Meeting of the Industrial Explosives Association, Pages 98–99).

1. First, 55 parts by weight of azodicarbonamide was blended with 55 parts by weight of sodium perchlorate and 5 parts by weight of zinc oxide to provide a composition of this invention.
2. This composition was compression-molded into a rectangular piece (8 mm×5 mm×50 mm)(pressure: 1.25 t/cm$^2$) and the sides of this piece were coated with a silicone resin as restrictor to prepare a test piece.
3. The test was performed using a chimney-type strand combustion tester. For measurement, two holes (0.6 mm in diameter) were drilled in the testpiece at a spacing of about 40 mm and after passage of fuses (0.5 mm in diameter), the testpiece was rigidly set in the tester.
4. After the temperature was set to the testing temperature (20° C.) in this condition, the testpiece was ignited with a Ni—Cr wire from above for combustion and the burning velocity (mm/sec.) was calculated from the difference between the fusion times of the two fuses and the distance between the holes.

5. The above measurement was carried out under the pressures of 10, 20 and 40 kgf/cm$^2$.

The measured burning velocities were 28.3 mm/sec. at 10 kgf/cm$^2$, 37.9 mm/sec. at 20 kgf/cm$^2$, and 46.0 mm/sec. at 40 kgf/cm$^2$.

EXAMPLE 8

Using the composition of this invention as prepared by blending 30 parts by weight of azodicarbonamide with 70 parts by weight of sodium perchlorate, the burning velocity (mm/sec.) was measured as in Example 7. No ignition occurred at 10 kgf/cm$^2$. At 40 kgf/cm$^2$, the burning velocity was 48.3 mm/sec.

EXAMPLE 9

An air bag inflator reactor was loaded with 40 g of pellets (12.3 mm in diameter×3 mm thick) of the composition of this invention as obtained by blending 45 parts by weight of azodicarbonamide with 55 parts by weight of potassium perchlorate and 10 parts by weight of copper oxide and this inflator was connected to a 28.6-liter tank equipped with a pressure sensor. The pellets were ignited with 1 g of B—$KNO_3$ for combustion of the composition of this invention. As a result, there was obtained a time-pressure curve similar to that obtained with 80 g of the prior art gas generating composition ($NaN_3$:$KClO_4$:$Fe_3O_4$=60:10:30) in a 28.6 liter tank.

EXAMPLE 10

Forty five parts by weight of azodicarbonamide, 55 parts by weight of potassium perchlorate, 30 parts by weight of potassium nitrate and 10 parts by weight of copper oxide and 1.0 part by weight of silicon dioxide were thoroughly mixed. A 10 wt. % aqueous solution of soluble starch was added to the reaction mixture so that the soluble starch content became 1.5 parts by weight, and the reaction mixture was further blended to give moist powder. The moist powder was granulated by a granulator and the resulting moist granules were dried. Using a hydraulic tablet machine, the granules were compressed to prepare pellets (6 mm in diameter, 3 mm high and 0.15 g in weight) of the gas generating composition.

Then, the following operation is described with reference to FIG. 8, which is a diagrammatic section view of the inflator used. Thus, a combustion chamber 21 of the inflator equipped with a gas outlet 25 (6 mm in diameter) was loaded with 0.8 g of boron/potassium nitrate (B—$KNO_3$) 24 as an enhancer and then loaded with 30 g of pellets of the above gas generating composition 22. This inflator was set in a 60-liter tank and the gas generating composition was ignited by application of electricity.

The maximum pressure in the inflator was 80 kgf/cm$^2$, and the maximum pressure in the 60-liter tank was 0.74 kgf/cm$^2$. After the operation, the gas in the tank was withdrawn through an outlet and collected in a 1-liter tedlar bag. The CO concentration in the collected gas was 0.25% when measured with use of a detecting tube.

Figure 1:
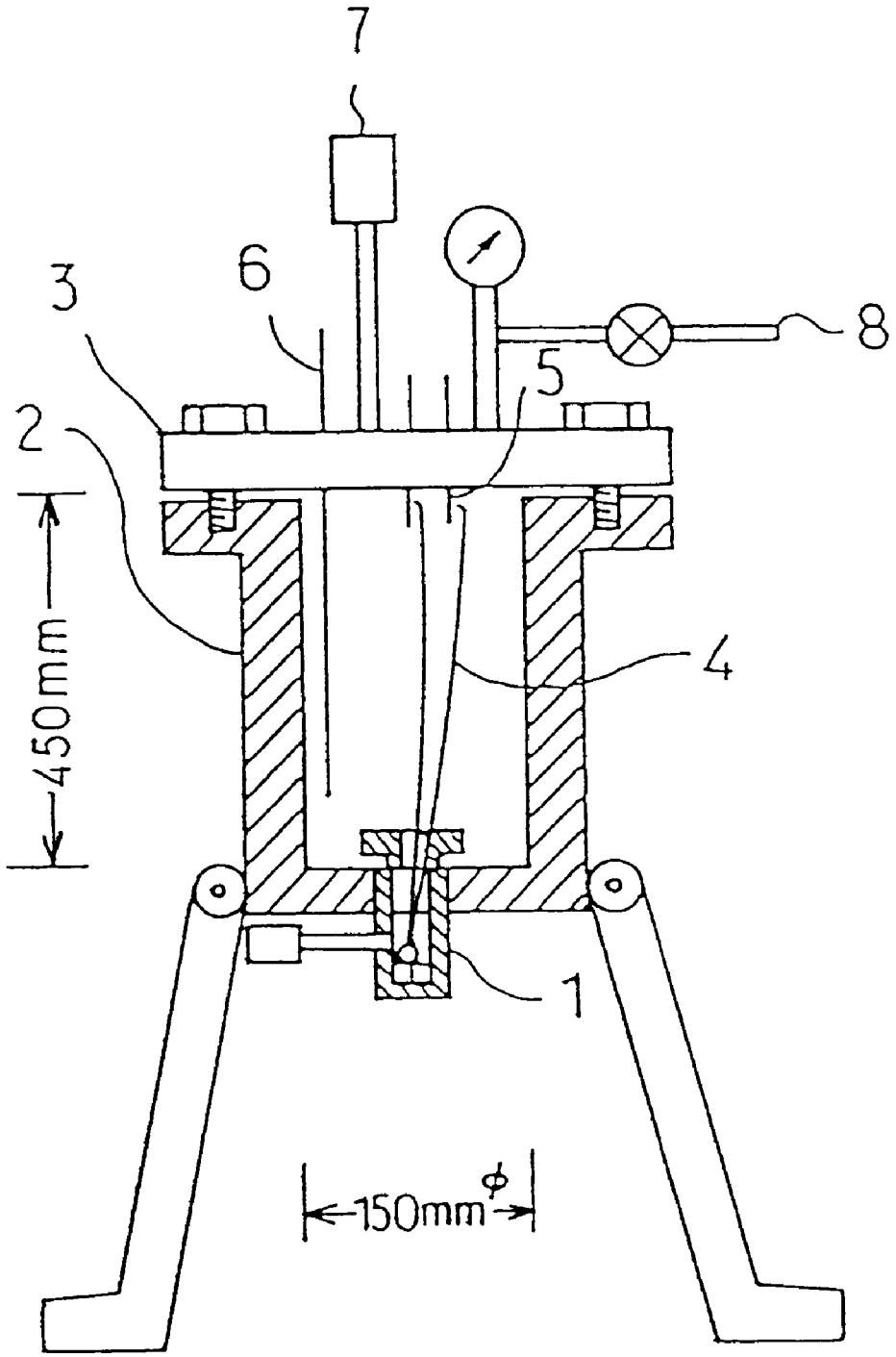
FIG. 1 is a longitudinal section view showing the gas trapping tank used in the tank test.
Figure 2:
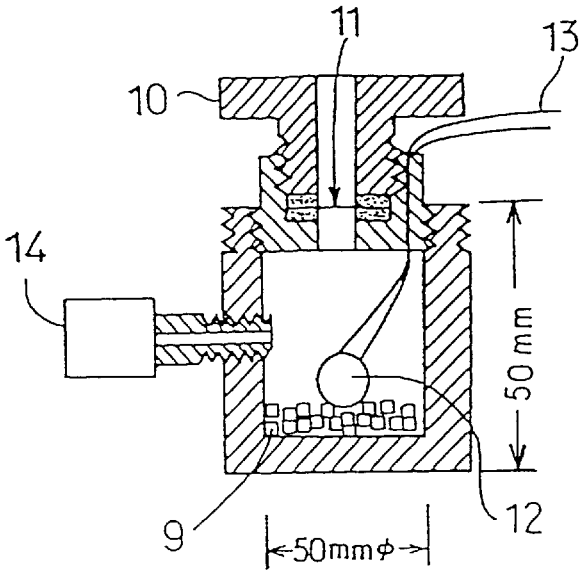
FIGS. 2 and 3 are diagrammatic illustrations showing the chamber mounted in the gas trapping tank on exaggerated scale.
Figure 3:
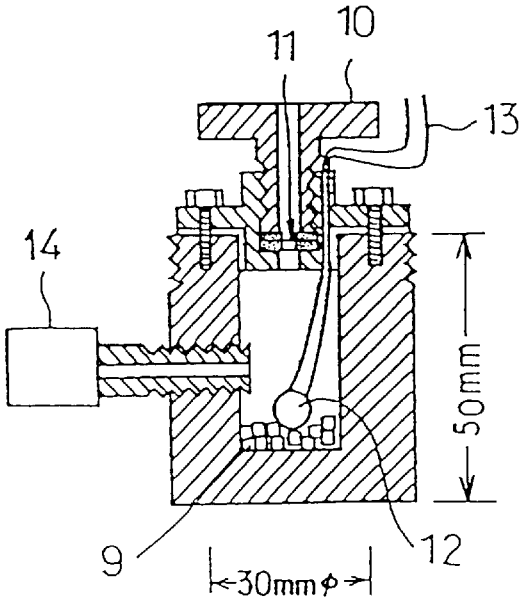
Figure 4:
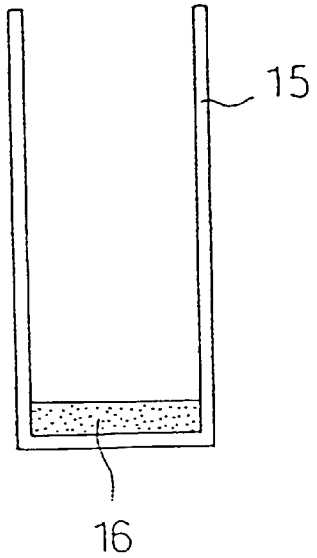
FIGS. 4–7 are diagrammatic representations of the procedure of the shock sensitivity test.
Figure 5:
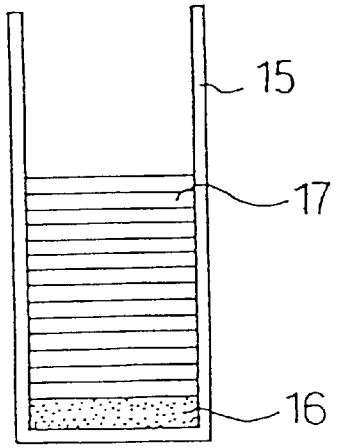
Figure 6:
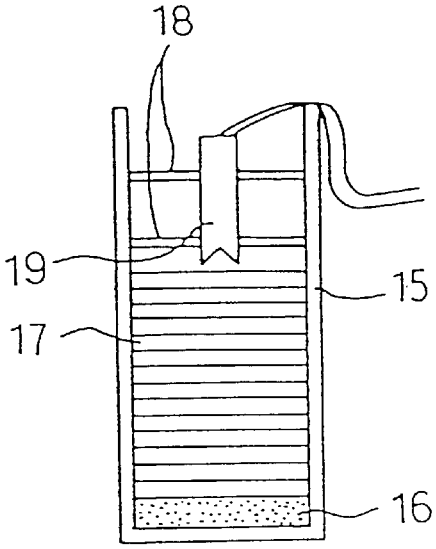
Figure 7:
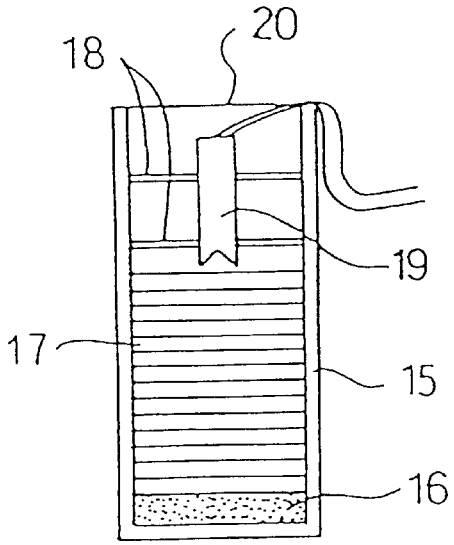
Figure 8:
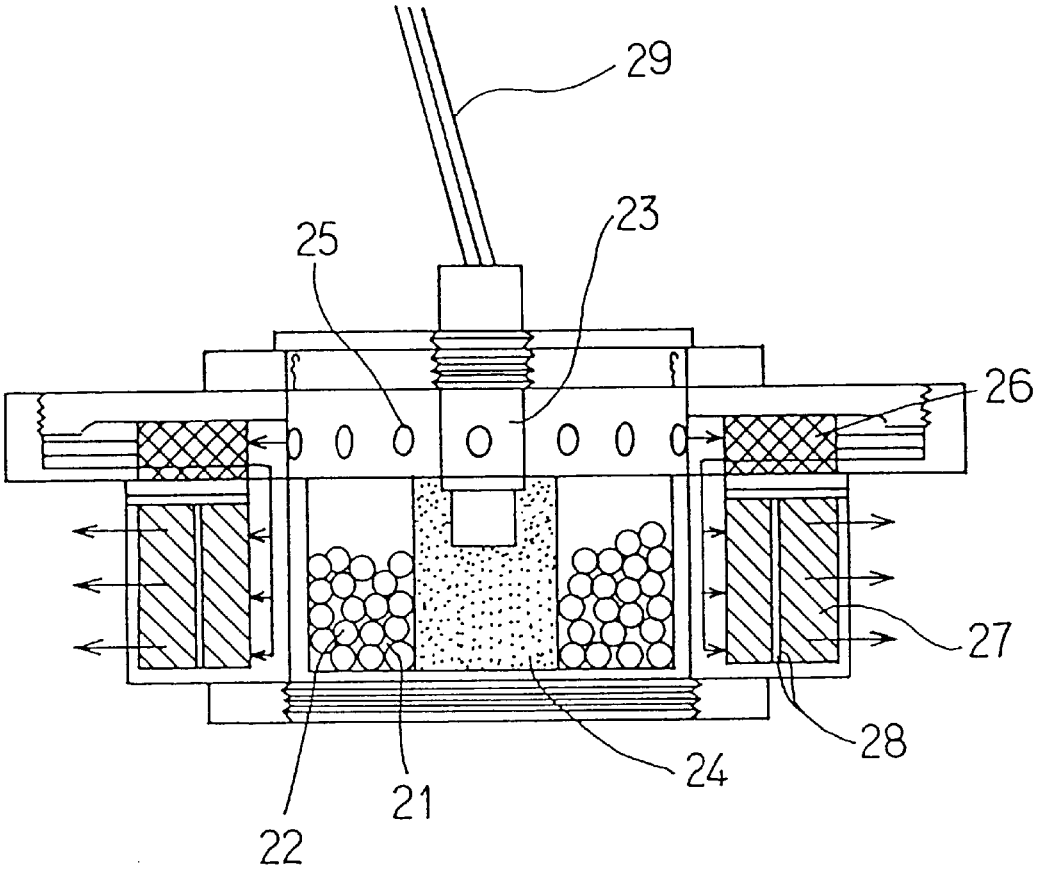
FIG. 8 is a diagrammatic section view of the inflator used in Example 10.

1. Chamber Reactor
2. Gas trapping tank
3. Tank cover
4. Leads
5. Electrodes
6. Thermocouples
7. Pressure sensor
8. Gas vent
9. Gas generating composition
10. Nozzle
11. Aluminum rupture plate
12. Ignitor
13. Ni—Cr wire
14. Pressure sensor
15. Steel vessel
16. Sample powder
17. Polyethylene card
18. Polyethylene card
19. Detonator
20. Paraffin
21. Combustion chamber
22. Gas generating composition
23. Squib
24. Enhancer
25. Gas outlet
26. Coolant
27. Wire netting filter
28. Ceramic filter
29. Leads

I claim:

1. An air bag gas generating composition comprising azodicarbonamide, about 20 to about 200 parts by weight of an oxo halogen acid salt, and about 5 to 350 parts by weight of a nitrate, relative to 100 parts by weight of the azodicarbonamide, and containing no sodium azide.

2. The gas generating composition of claim 1 wherein the oxo halogen acid salt is a halogenate and/or a perhalogenate.

3. The gas generating composition of claim 1 wherein the halogenate is an alkali metal halogenate.

4. The gas generating composition of claim 1 wherein the perhalogenate is an alkali metal perhalogenate.

5. The gas generating composition of claim 1 wherein the nitrate is at least one member selected from the group consisting of alkali metal nitrates, alkaline earth metal nitrates and ammonium nitrate.

6. The gas generating composition of claim 1, which contains about 30 to 180 parts by weight of the oxo halogen acid salt and about 30 to 150 parts by weight of the nitrate, relative to 100 parts by weight of the azodicarbonamide.

7. The gas generating composition of claim 1, wherein the oxo halogen acid salt is an alkali metal perchlorate or chlorate and the nitrate is an alkali metal or alkaline earth metal nitrate.

8. The gas generating composition of claim 1, which further contains at least one member selected from the group consisting of combustion control catalysts and antidetonation agents.

9. The gas generating composition of claim 8 wherein the combustion control catalyst is at least one member selected from the group consisting of the oxides, chlorides and carbonates of Period 3, Period 4 or Period 6 elements of the periodic table of the elements.

10. The gas generating composition of claim 8 wherein the combustion control catalyst is at least one member selected from the group consisting of cellulosic compounds and organic polymers.

* * * * *